US006076895A

United States Patent [19]

Ino et al.

[11] Patent Number: 6,076,895

[45] Date of Patent: Jun. 20, 2000

[54] ROAD CUTTING MACHINE WITH SPECIFIC CUTTING BIT ARRANGEMENT

[75] Inventors: Syoji Ino; Yoshiyuki Horie, both of Hiroshima, Japan

[73] Assignee: ITO, Co., Ltd., Hiroshima, Japan

[21] Appl. No.: 09/171,490

[22] PCT Filed: Jun. 27, 1997

[86] PCT No.: PCT/JP97/02248

§ 371 Date: Oct. 20, 1998

§ 102(e) Date: Oct. 20, 1998

[87] PCT Pub. No.: WO98/42916

PCT Pub. Date: Oct. 1, 1998

[30] Foreign Application Priority Data

Mar. 25, 1997 [JP] Japan ..... 9-071475

[51] Int. Cl.[7] ..... E01C 23/09

[52] U.S. Cl. ..... 299/41.1; 299/36.1

[58] Field of Search ..... 299/41.1, 55, 60, 299/36.1; 125/3

[56] References Cited

U.S. PATENT DOCUMENTS 4,968,101 11/1990 Bossow ..... 299/41.1
5,470,131 11/1995 Nolan et al. ..... 299/41.1

FOREIGN PATENT DOCUMENTS 3021022 11/1995 Japan .
8-246414 9/1996 Japan .
9-195222 7/1997 Japan .

*Primary Examiner*—David Bagnell
*Assistant Examiner*—Sunil Singh
*Attorney, Agent, or Firm*—Wenderoth, Lind & Ponack, L.L.P.

[57] ABSTRACT

A road cutting machine comprises a machine body (2) mounted to a travelling body (1) to be swivel, a boom (4) mounted to the machine body to be vertically swingable, an arm (6) mounted to the boom to be swingable in a vertical direction and a road cutting apparatus (A) mounted to the arm, the road cutting apparatus includes a mounting member (20) attached to the arm, a hydraulic motor (50) mounted to the mounting member and a cutting bit mounting member (99) rotated by the hydraulic motor and having a plurality of cutting bits, the cutting bit mounting member is provided with a main cutting bit (100) mounted to a center of rotation, a plurality of flat surface cutting bits (103, 104) attached in a range from the rotation center side to an outer periphery side, a plurality of sweep-cutting bits (105) attached on the outer periphery side and a plurality of side surface cutting bits (106, 107) attached on the outer periphery side, a bit tip end portion (100*a*) of the main cutting bit is positioned in a lowermost position, bit tip end portions (105*a*) of the sweep-cutting bits are positioned above the bit tip end portion of the main cutting bit, bit tip end portions (103*a*, 104*a*) of the flat surface cutting bits are positioned above the tip end portions of the sweeping cutting bits, and bit tip end portions (106*a*, 107*a*) of the side surface cutting bits are positioned in a uppermost portions.

5 Claims, 10 Drawing Sheets

ROAD CUTTING MACHINE WITH SPECIFIC CUTTING BIT ARRANGEMENT

TECHNICAL FIELD OF THE INVENTION

The present invention relates to a road cutting machine for cutting a road such as road-way, bridge-road, foot-way or the like on which asphalt pavement or cement concrete pavement is effected to thereby provide a flat road surface.

BACKGROUND ART

When a road has been used for a long time, a road surface may be damaged as a rutted road having irregular surface or cracked, so that it becomes necessary to cut such road so as to provide a flat surface or carry out repairing working by cutting and removing the pavement and then perform re-pavement.

There is known, as a machine for cutting the road surface, a road cutter having a vehicle body to which a drum-type road cutting apparatus is mounted to be moved in an elevating manner and the road is cut by the cutting apparatus while travelling the vehicle body.

Furthermore, as shown in a publication of the Japanese Utility Model Registration No. 3021022, there is also known a road cutter in which a cutting apparatus, having a member (cutting member) rotated by a motor, to which a plurality of claws are formed, is mounted to a front end portion of an arm of a power shovel and the road is cut by the claws by bilaterally swinging them.

However, the road cutting machine called as road cutter as mentioned above is a machine cutting the road while traveling thereon and the road cutting apparatus thereof has a cutting bit which is mounted to the drum rotatable about a horizontal axis, so that it is impossible for such cutter to cut a peripheral portion of a manhole and a portion near a road shoulder.

Because of this reason, in the known art, the peripheral road portion of the manhole and the road portion near the shoulder, which are not cut in the conventional machine, have been cut through a chipping working of workers by means of compressor or breaker, which involves much troublesome working and much time, thus providing a bad workability, and moreover, there is caused a problem of generating noises of the compressor and the breaker in the chipping working, which causes a problem of noise pollution.

Furthermore, in the prior art using the power shovel, since the road is cut while pressing the claws of the cutting member against the road surface and bilaterally swinging the arm in a manner like sweeping the road surface, the peripheral road portion of the manhole and the road portion near the shoulder can be cut. However, in this manner, when the deep road cutting work is performed by swinging the arm downward and pressing the cutting member against the road surface, it is difficult to prevent the cutting member from being swung horizontally and vertically by a cutting reaction force applied to the cutting member during the cutting working, so that the deep cutting work with high efficiency could not be expected.

The present invention therefore provides a road cutting machine capable of solving the above mentioned problems.

DISCLOSURE OF THE INVENTION

The first embodiment of the road cutting machine according to the present invention comprises a machine body mounted to a traveling body to be swivel, a boom mounted to the machine body to be swingable in a vertical direction, an arm mounted to the boom to be swingable in a vertical direction and a road cutting apparatus mounted to the arm, the road cutting apparatus including a mounting member attached to the arm, a hydraulic motor mounted to the mounting member and a cutting bit mounting member rotated by the hydraulic motor and provided with a plurality of cutting bits, and the cutting bit mounting member being provided with a main cutting bit mounted to a center of rotation, a plurality of flat surface cutting bits attached in a range from the rotation center side to an outer periphery side, a plurality of sweep-cutting bits attached on the outer periphery side and a plurality of side surface cutting bits attached on the outer periphery side, wherein a bit tip end portion of the main cutting bit is positioned in a lowermost position, bit tip end portions of the sweep-cutting bits are positioned above the bit tip end portion of the main cutting bit, bit tip end portions of the flat surface cutting bits are positioned above the tip end portions of the sweeping cutting bits, and bit tip end portions of the side surface cutting bits are positioned in a uppermost portions.

According to this structure, when the cutting bit mounting member is moved towards the road surface, the main cutting bit first contacts the road surface, then, the flat surface cutting bits contact the road surface, and finally, the side surface cutting bits contact the road surface.

Accordingly, when it is required to deeply cut the road surface, the main cutting bit digs the road surface in shape of hole, so that the cutting bit mounting member is rotated around the main cutting bit. Thereafter, the outer peripheral road surface portion is cut in shape of ring by the sweep-cutting bits and the inside portion of the ring-shaped cut portion is then cut by the flat surface cutting bits.

Thus, the cutting bit mounting member never be swung in the front and rear direction as well as bilateral direction due to the cutting reaction force, so that the road surface can be deeply cut with high efficiency.

Furthermore, the main cutting bit can cut the road surface in the hole shape by pressing the cutting bit mounting member against the road surface with a light force and the sweep-cutting bits are contacted to the road surface.

As mentioned above, only the sweep-cutting bits can be contacted to the road surface by pushing, with a light force, the cutting bit mounting member against the road surface by making weak the vertical swinging force of the boom.

Accordingly, the road surface can be cut in circular shape only by the sweep-cutting bits by bilaterally swivelling the machine body to thereby bilaterally swing the cutting bit mounting member, thus improving the sweep-cutting efficiency.

Furthermore, since the bit tip end portions of the side surface cutting bits are positioned to the uppermost and most side portion, the vertical surface portion of the road surface can be cut by the side surface cutting bits by bilaterally moving the cutting bit mounting member.

Accordingly, the vertical surface portions of stepped portions at the peripheral portion of a manhole and near a road shoulder portion can be effectively cut by the side surface cutting bits.

In such structure, it may be preferred that the flat surface cutting bits are composed of a plurality of flat surface cutting bits arranged on the side of the rotation center and a plurality of flat surface cutting bits arranged on the side of the outer periphery in a manner such that the flat surface cutting bits on the side of the outer periphery have bit tip end portions positioned slightly below the bit tip end portions of the flat surface cutting bits on the side of the rotation center.

According to this structure, the road surface is first cut in shape of ring by the flat surface cutting bits on the side of the outer periphery and then the inside portion of the ring-shaped cut surface is cut by the flat surface cutting bit on the side of the rotation center, so that the road surface can be cut in two stages, and hence, a wide road surface can be effectively cut with a light force.

Furthermore, in the structure mentioned above, it may be preferred that the flat surface cutting bits on the side of the rotation center are attached at positions different from the rotation center, respectively, and shifted in the rotating direction, respectively, and the flat surface cutting bits on the side of the outer periphery are attached at positions different from the rotation center with substantially equally separated relation from each other in the rotating direction.

According to this structure, a plurality of flat surface cutting bits on the side of the rotation center and a plurality of flat surface cutting bits on the side of the outer periphery contact the portions different in distances from the rotation center, respectively, and describe concentric cutting tracks, so that the road surface can be cut in circular shapes effectively.

Still furthermore, in the structure mentioned above, it may be preferred that the sweep-cutting bits and the side surface cutting bits are arranged so as to be obliquely disposed forward and outward in the rotating direction with respect to a perpendicular direction.

According to this structure, the sweep-cutting bits can attain the side surface cutting function and the side surface cutting bits can attain the flat surface cutting function, thus improving the side surface cutting efficiency as well as the flat surface cutting efficiency.

Still furthermore, in the structure mentioned above, it may be preferred that the side surface cutting bits are composed of a first group of side surface cutting bits and a second group of side surface cutting bits in a manner such that the second group of side surface cutting bits have bit tip end portions positioned above bit tip end portions of the first group of side surface cutting bits.

According to this structure, the vertical road surface portion can be cut in vertical two stages, thus improving the cutting efficiency.

BRIEF DESCRIPTION OF THE DRAWINGS

The present invention will be more understandable by way of the following detailed description and accompanying drawings representing an embodiment of the present invention. Further, the embodiment represented by the accompanying drawings are not intended to specify the invention and are mere for the easy explanation and understanding thereof.

In the accompanying drawings.

PREFERABLE MODE FOR EMBODYING THE INVENTION

A road cutting machine according to a preferred embodiment of the present invention will be described hereunder with reference to the accompanying drawings.

(Entire Structure of Road Cutting Machine)

Figure 1:
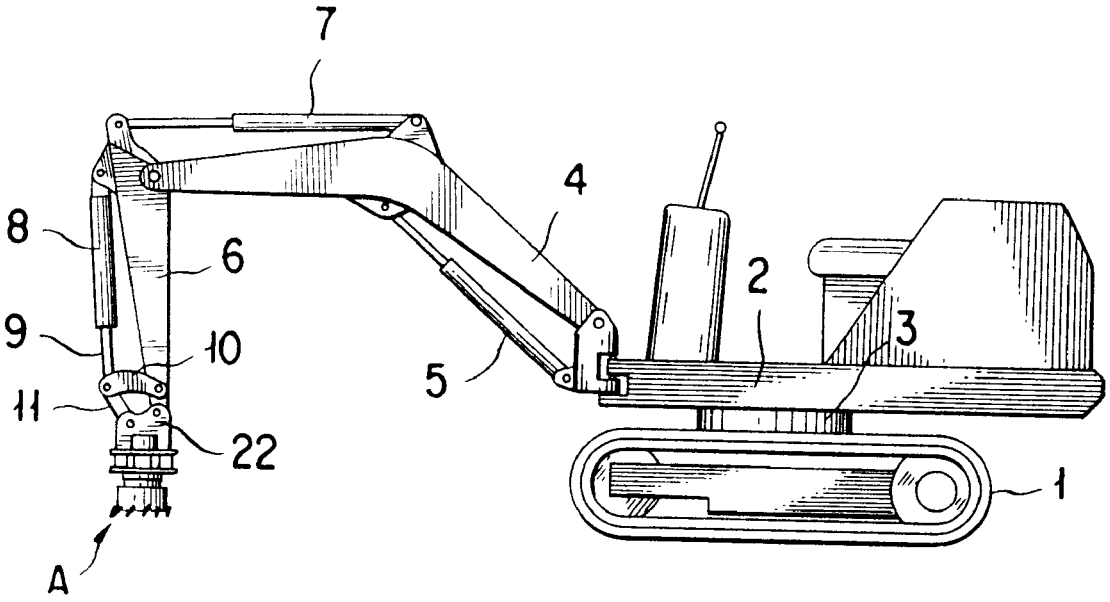
FIG. 1 is a front view of an entire road cutting machine of one embodiment of the present invention.

As shown in FIG. 1, a machine body 2 is mounted to a traveling body 1 to be swivelable through a swiveling mechanism 3. A boom 4 is mounted to the machine body 2 to be vertically swingable through a boom cylinder 5, and an arm 6 is mounted to the boom 4 to be vertically swingable through an arm cylinder 7. A cylinder 8 for a working machine is attached to the arm 6, and a first link 10 and a second link 11 are connected, through a pin, to a front end portion of a piston rod 9 of the working machine cylinder 8, the first link 10 being connected to the arm 6 through a pin.

The above-mentioned structure is substantially the same as a body portion of a power shovel, and a structure in which a bucket is mounted to the front end portion of the arm 6 to be vertically swingable through the working machine cylinder 8 constitutes a power shovel. However, in the embodiment shown in FIG. 1, a road cutting apparatus A is mounted to the front end portion of the arm 6 to be vertically swingable through the working machine cylinder 8, thus constituting a road cutting machine.

(Concrete Structure of Road Cutting Apparatus A)

Figure 2:
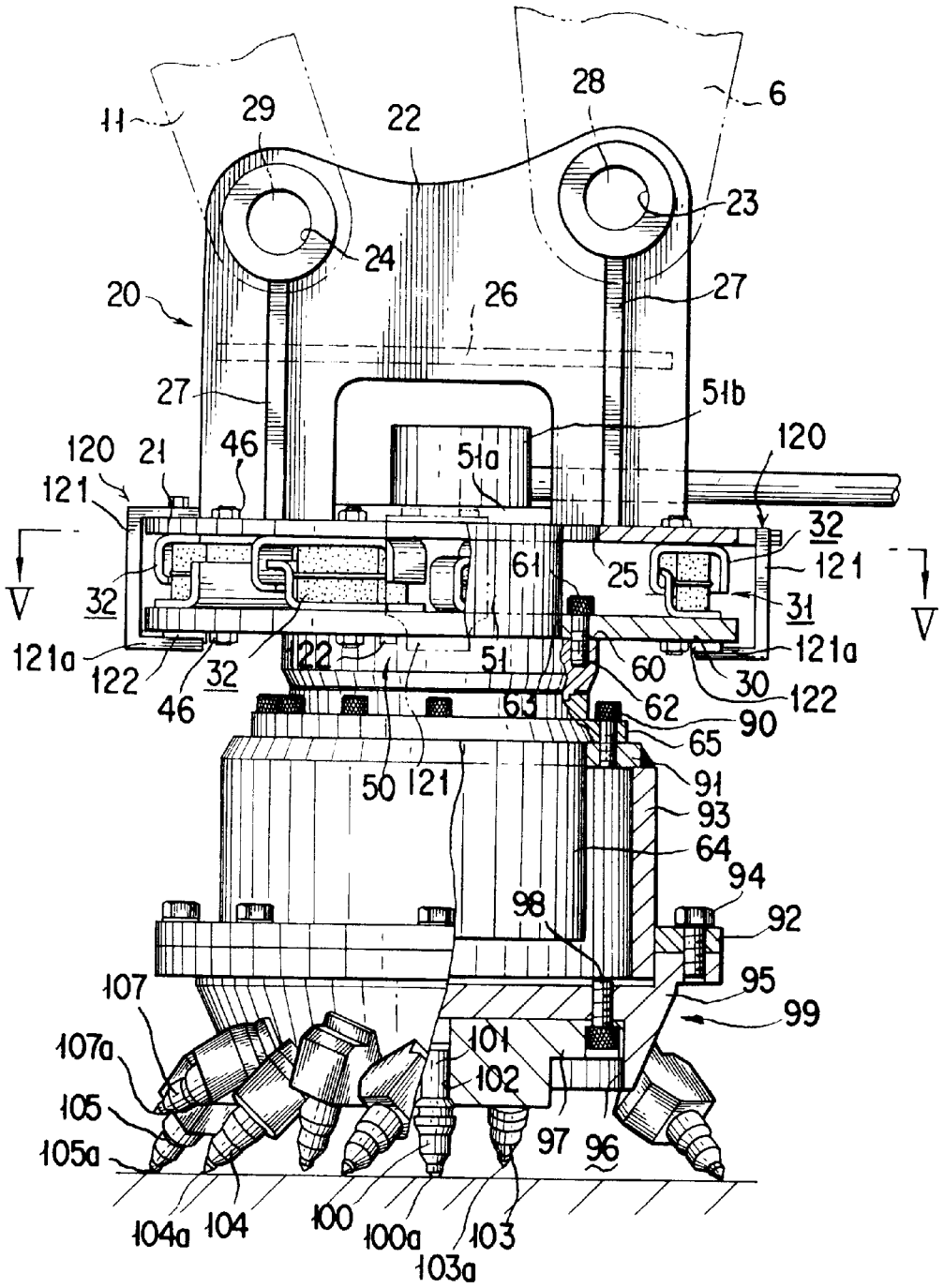
FIG. 2 is a front view, partially cut away, of a road cutting apparatus of the embodiment shown in FIG. 1.
Figure 3:
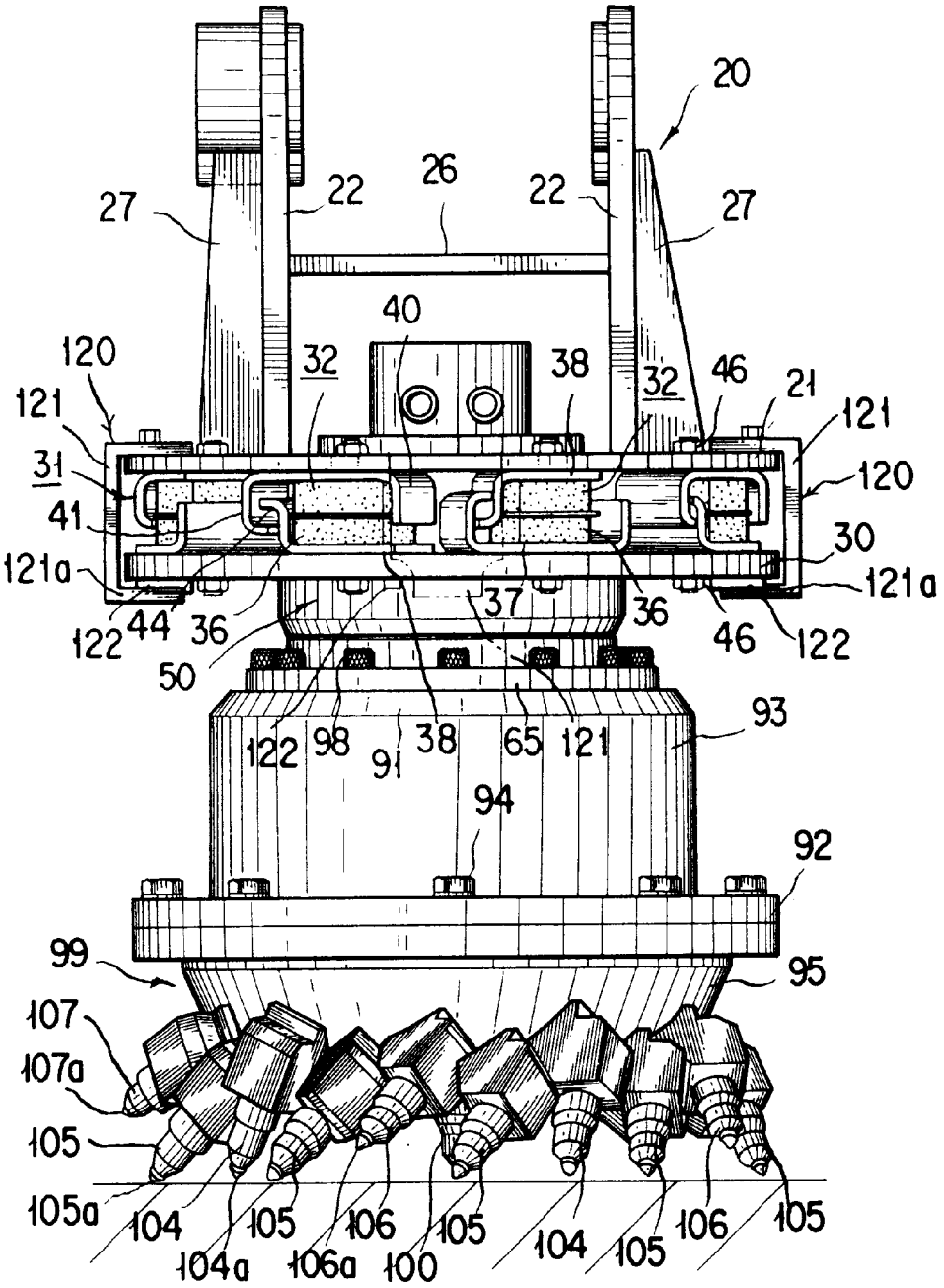
FIG. 3 is a side view of the road cutting apparatus.
Figure 4:
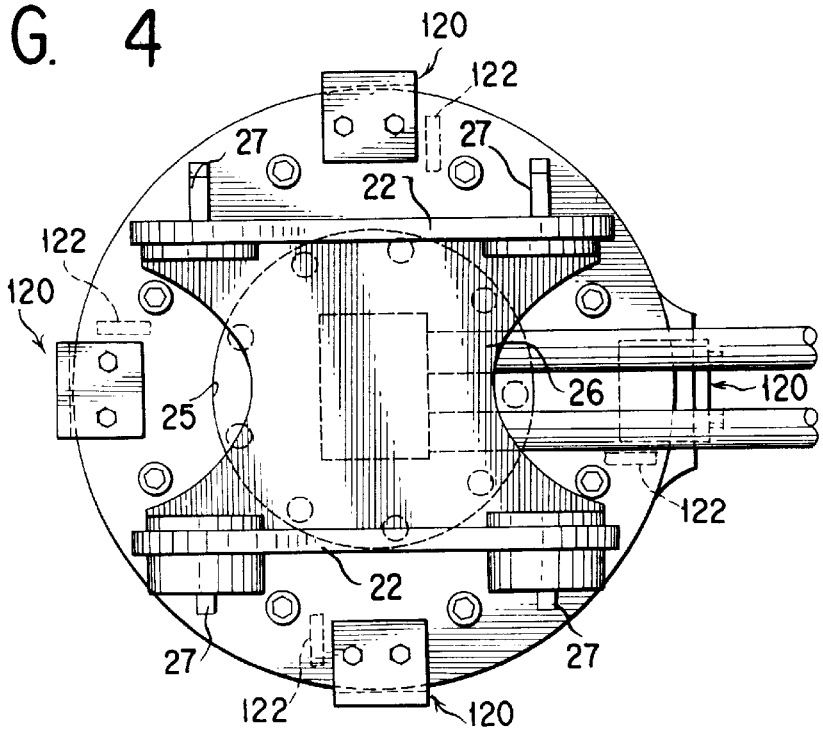
FIG. 4 is a plan view of the road cutting apparatus.

The road cutting apparatus A is, as shown in FIGS. 2, 3 and 4, is provided with a mounting member 20 for mounting the road cutting apparatus A to the arm 6.

The mounting member 20 is composed of a disc-shaped transverse plate member 21 and a pair of vertical plate members 22 secured on an upper surface of the transverse plate member 21 in parallel to each other with a space therebetween. A first pin hole 23 and a second pin hole 24 are formed to portions near the upper ends of the respective vertical plate members 22, and a circular hole 25 is formed to a portion of the transverse plate member 21 between the respective vertical plate members 22.

A plate-shaped reinforcing member 26 is horizontally beamed between intermediate portions, in the vertical direction, of the respective vertical plate members 22, and reinforcing ribs 27 are also secured to the respective vertical plate members 22 and the transverse plate member 21.

The paired vertical plate members 22 of the mounting member 20 are opposed to both side surfaces of the arm and both side surfaces of the second link 11 shown in FIGS. 1 and 2 in a manner such that the paired vertical plate members 22 and the arm 6 are coupled by a first pin 28 fitted into the first pin hole 23 and a hole formed to the front end portion of the arm 6 and the paired vertical plate members 22 and the second link 11 are coupled by a second pin 29 which is fitted into the second pin hole 24 and a hole formed to the front end portion of the second link 11.

As mentioned above, the mounting member 20, the arm 6 and the second link 11 can be easily coupled by fitting the first and second pins 28 and 29 and easily removed by withdrawing the first and second pins 28 and 29, whereby the road cutting apparatus A can be mounted to or removed from the arm 6 as like the mounting or removing of the bucket.

A plate-shaped motor mounting member 30 is mounted to a lower surface of the transverse plate member 21 of the mounting member 20 through a shock-absorber mechanism 31.

Figure 5:
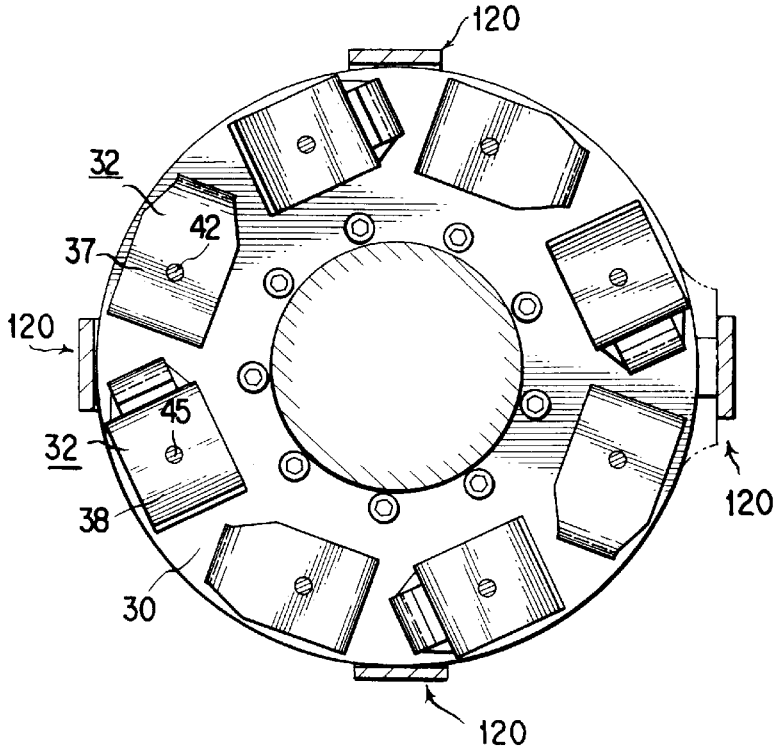
FIG. 5 is a sectional view taken along the line V—V in FIG. 2.
Figure 6:
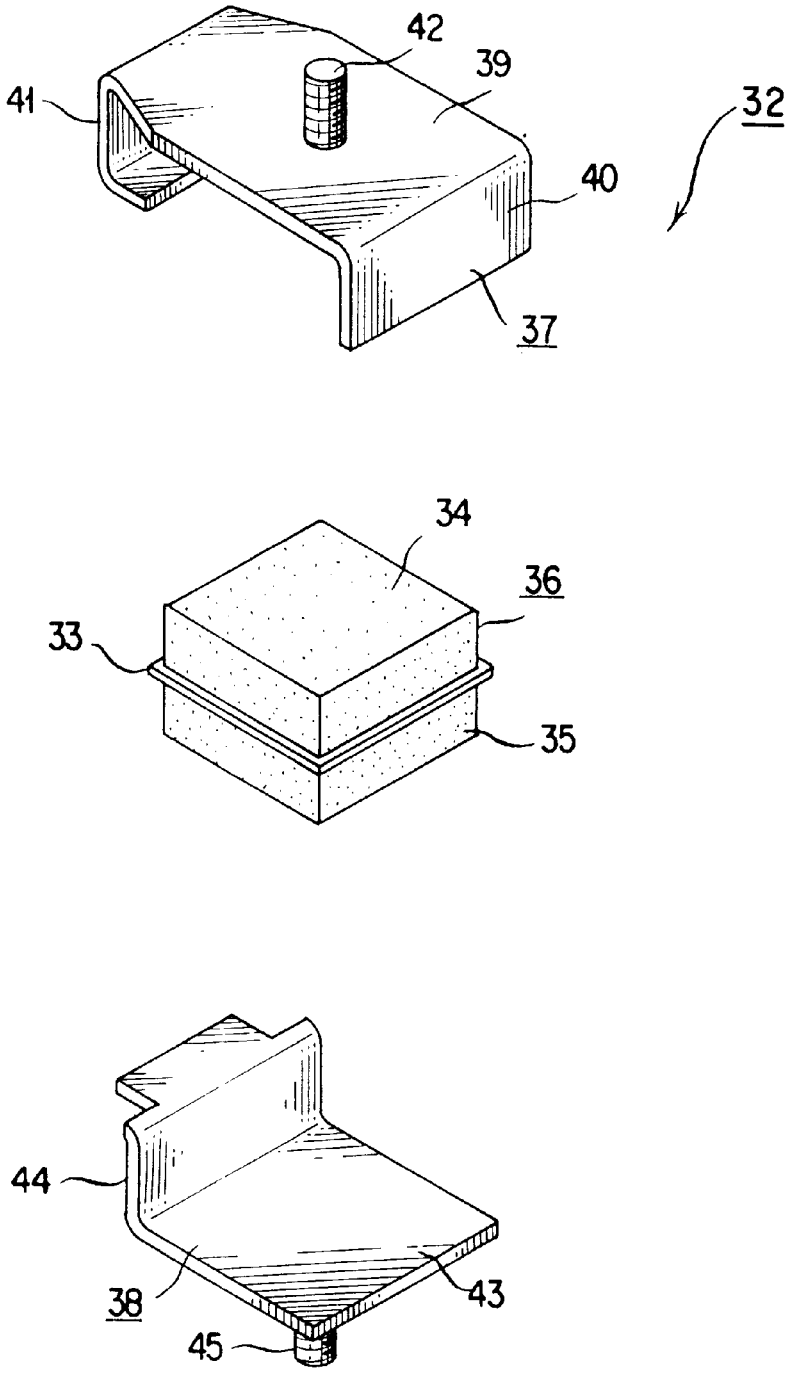
FIG. 6 is a developed perspective view of a shock absorber of the road cutting apparatus.

The shock-absorber mechanism 31 is, as shown in FIG. 5, composed of a plurality of shock-absorbers 32 arranged almost along the circumferential direction of the motor mounting member 30. Each of the shock-absorbers 32 is, as shown in FIG. 6, composed of an absorber body 36, a metallic first mounting plate 37 and a metallic second mounting plate 38, the absorber body 36 being formed by fixing, through sintering process, a rectangular first absorber member 34 and a rectangular second absorber member 35, both having elastic property, to upper and lower surfaces of a rectangular metal plate 33, respectively, and the first and second mounting plates 37 and 38 being fixed to the first and second absorber members 34 and 35, respectively, through sintering process.

The first mounting plate 37 is composed of a transverse piece 39, one side vertical piece 40 integrally formed to one side edge of the transverse piece 39 and a hook-shaped other side vertical piece 41 integrally formed to another side edge of the transverse piece 39 so as to provide substantially ]-shaped sectional shape opened downward. More concretely, the first mounting plate 37 is formed by bending one sheet of plate member, and a mounting bolt 42 is fixed to the almost center portion of an upper surface of the transverse piece 39.

The second mounting plate 38 is composed of a transverse piece 43 and a hook-shaped vertical piece 44 integrally formed to one side edge of the transverse piece 43 so as to provide substantially L-shaped section opened upward. More concretely, the second mounting piece is formed by bending one sheet of plate member, and a mounting bolt 45 is fixed to the almost center portion of a lower surface of the transverse piece 43.

Figure 7:
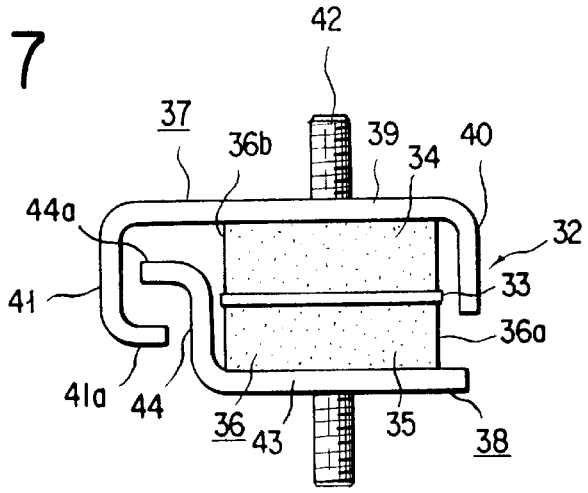
FIG. 7 is a front view of the shock absorber.

The one side vertical piece 40 of the first mounting plate 37 is opposed with space, as shown in FIG. 7, to one side surface 36*a* of the shock-absorber body 36, the vertical piece 44 of the second mounting plate 38 is opposed with space to another side surface 36*b* of the shock-absorber body 36, and the other side vertical piece 41 of the first mounting plate 37 and the vertical piece 44 of the second mounting plate 38 are arranged so that bent pieces 41*a* and 44*a* thereof are opposed to each other in a manner such that when the first and second mounting plates 37 and 38 are separated relatively in the vertical direction, the bent pieces 41*a* and 44*a* are contacted to each other.

The shock-absorbers 32 are arranged in a fashion upside down, as shown in FIGS. 2, 3 and 5, along the circumference, with the rotation center being the center thereof, of a hydraulic motor described in detail hereinlater, and the shock-absorbers 32 are mounted to the motor mounting member 30 by inserting the fastening bolt 42 for the first mounting plate 37 and the fastening bolt 45 for the second mounting plate 38 into the through holes formed to the transverse plate member 21 of the mounting member 20 and the motor mounting member 30, respectively, and screwing nuts 46 to both the fastening bolts 42 and 45 to thereby fasten the shock-absorbers 32 to the motor mounting member 30.

A hydraulic motor 50 provided with a speed reduction means is mounted to the central portion of the motor mounting member 30.

Figure 8:
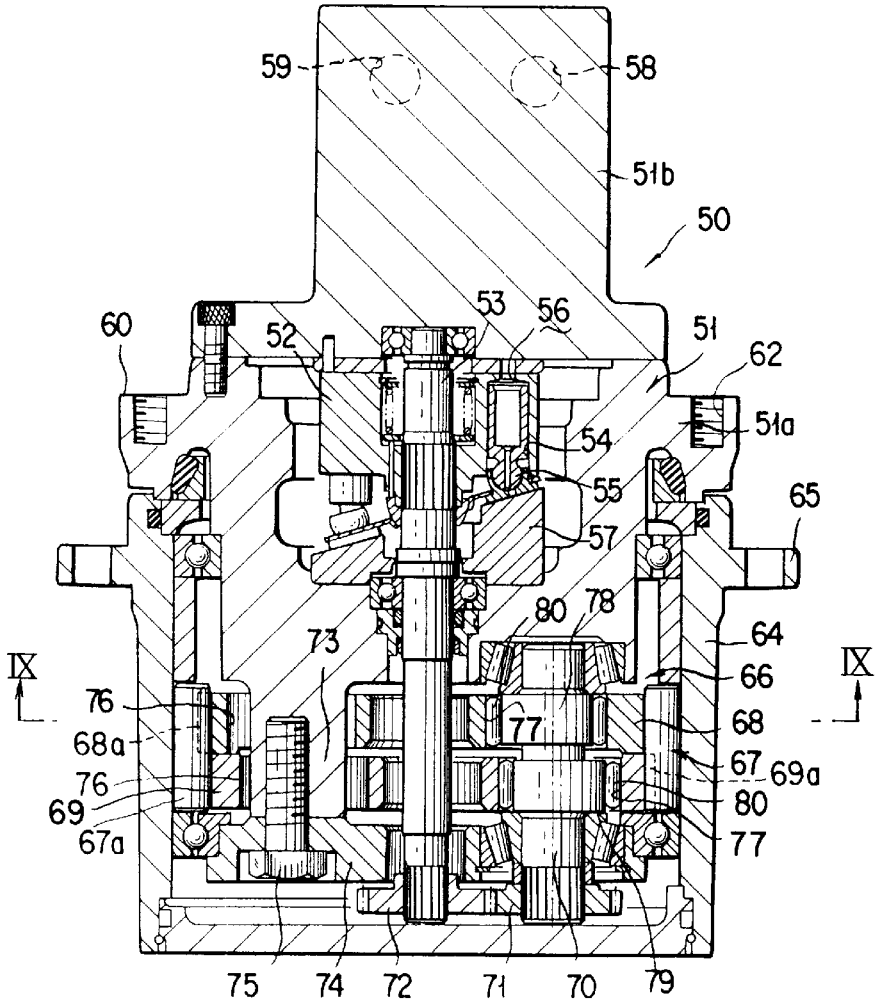
FIG. 8 is a sectional view of a hydraulic motor of the road cutting apparatus.

The hydraulic motor 50 is constructed, as shown in FIG. 8, as a swash-plate-type hydraulic motor, such that a cylinder block 52 and a shaft 53 are arranged in a motor casing 51 to be rotatable, pistons 55 are fitted into a plurality of cylinder bores 54 of the cylinder block 52 to thereby define a cylinder chamber 56, and the front end portions of the respective pistons 55 are slid in the axial direction along a swash plate 57.

The motor casing 51 is composed of a housing 51*a* and an end cover 51*b*, and an inlet port 58 for supplying a pressurized oil into the cylinder chamber 56 and an outlet port 59 for discharging the pressurized oil in the cylinder chamber 56 to a tank are formed to the end cover 51*b*.

The housing 51*a* is formed with an annular mounting surface 60, which abuts against the lower surface of the motor mounting member 30, and in this state, a bolt 61 is screwed into a bolt hole 62 and then fastened thereto, thus the hydraulic motor 50 being fastened to the motor mounting member 30. The end cover 51*b* of the motor casing 51 projects upward over a hole 63 formed to the motor mounting member 30 and the hole 25 formed to the transverse plate member 21 of the mounting member 20 so as to be positioned between a pair of vertical plate members 22.

A cylindrical rotational member 64 is attached to an outer peripheral surface of the housing 51*a* of the motor case 51 to be rotatable and a flange 65 for mounting is integrally formed to an axially intermediate portion of the outer peripheral surface of the rotational member 64.

The rotational member 64 is connected to the shaft 53 of the hydraulic motor 50 through a speed reduction gear mechanism 66.

Figure 9:
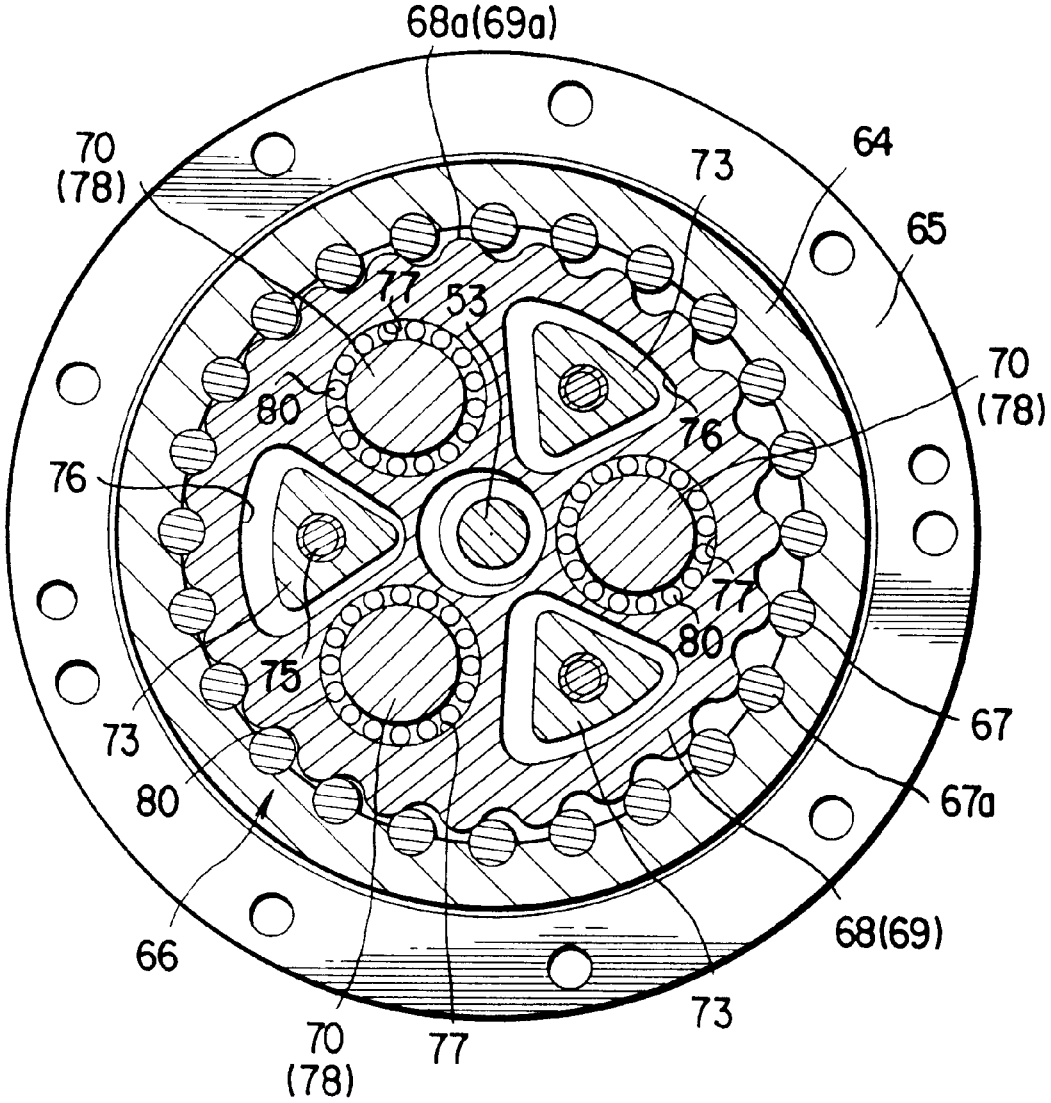
FIG. 9 is a sectional view taken along the line IX—IX in FIG. 8.

The speed reduction gear mechanism 66 comprises, as shown in FIGS. 8 and 9, a ring gear 67 formed by fitting and fastening pins 67*a* to the inner peripheral surface of the rotational member 64, a first gear 68 and a second gear 69 which are meshed with the ring gear 67, three rotational shafts 70 for rotating these first and second gears 68 and 69, driven gears 71 mounted to the rotational shafts 70, and a drive gear 72 mounted to the shaft 53 and adapted to be meshed with the driven gears 71.

The ring gear 67 is formed by securing a plurality of pins 67*a* to the inner peripheral surface of the rotational member 67 and the pins 67 constitute gear teeth, respectively.

Three projections 73 are integrally formed to the housing 51*a* so as to extend in the axial direction and a plate 74 is fastened to these projections 73 by means of bolts 75.

The first and second gears 68 and 69 are formed with three windows 76 into which the respective projections 73 are fitted and three through holes 77 through which the respective rotational shafts 70 penetrate. The first and second gears 68 and 69 have gear teeth less by one tooth in number than those of the ring gear 67.

The rotational shafts 70 are supported at both ends thereof by the housing 51*a* and the plate 74 to be rotatable, and a first eccentric portion 78 and a second eccentric portion 79 are mounted to the intermediate portions of the shafts 70 with phases shifted by 180° from each other. The first eccentric portion 78 is supported by a hole 77 formed to the first gear 68 through a bearing 80 and the second eccentric portion 79 is supported by a hole 77 of the second gear 69 through a bearing 80.

According to the structure mentioned above, when the shaft 53 of the hydraulic motor 50 rotates, the rotational shafts 70 are rotated through the drive gear 72 and the driven gear 71, whereby the first and second gears 68 and 69 are rotated in the eccentric manner with the phases being shifted by 180° from each other to thereby rotate the ring gear 67 and, hence, the rotational member 64 is rotated. As a result, the rotational member 64 is rotated extremely less in rotating number than that of the shaft 53.

As shown in FIGS. 2 and 3, a mounting jaw 91 is fastened to the mounting flange 65 of the rotational member 64 by means of bolt 90. A box-shaped member 93 having a mounting flange 92 is secured to the mounting jaw 91. A cylindrical member 95 is fastened to the mounting flange 92 of the box-shaped member 93 by means of bolt 94 and a plate 97 is fastened to a circular recessed portion 96 of the cylindrical member 95 by means of bolt 98 to thereby constitute a cutter bit mounting member 99. According to this structure, when the rotational member 64 is rotated, the cutting bit mounting member 99 is also rotated.

A main cutting bit 100 is mounted to the rotational center of the lower surface of the plate 97 so as to extend directly downward. The main cutting bit 100 is a conical bit having a mounting shaft 101 which is press fitted and mounted to a vertical hole 102 perforated to the rotational center of the plate 97.

A plurality of flat surface cutting bits 103 for cutting portions of a road surface to be cut in the vicinity of the central portion of the road surface so as to provide flat surfaces are mounted to portions in the vicinity of the central portion of the plate 97, and a plurality of flat surface cutting bits 104 for cutting portions of a road surface to be cut in the vicinity of the outer peripheral portion of the road surface so as to provide flat surfaces are mounted to portions near outer peripheral portions of the lower surface of the cylindrical member 95. A plurality of sweep-cutting bits 105 are also mounted to portions near the outer peripheral portion of the lower surface of the cylindrical member 95. Furthermore, a plurality of first side surface cutting bits 106 and a plurality of second side surface cutting bits 107 are also mounted to portions near the outer peripheral portion of the lower surface of the cylindrical member 95.

Figure 10:
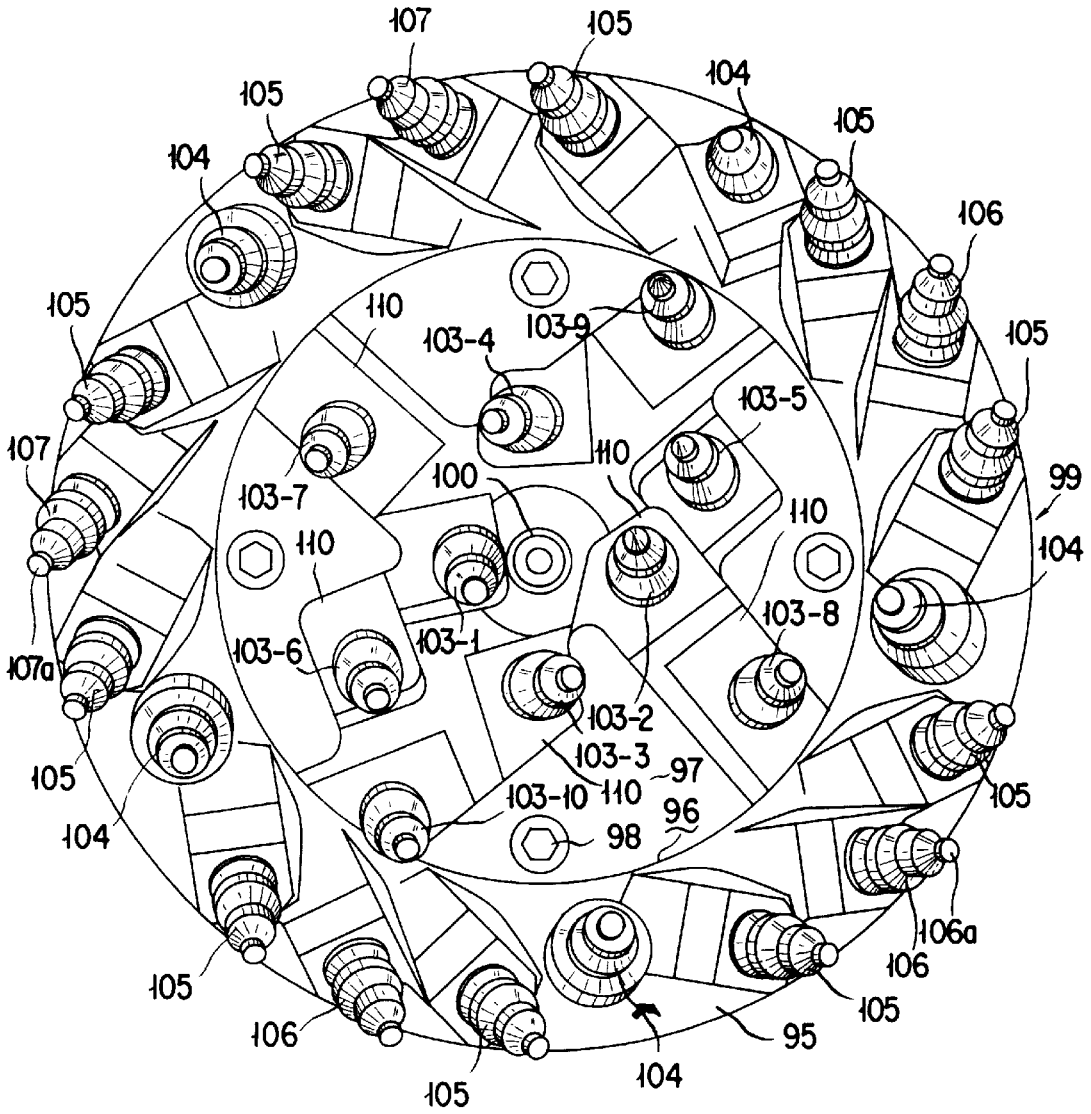
FIG. 10 is a plan view showing an arrangement of cutting bits of the road cutting apparatus.
Figure 11:
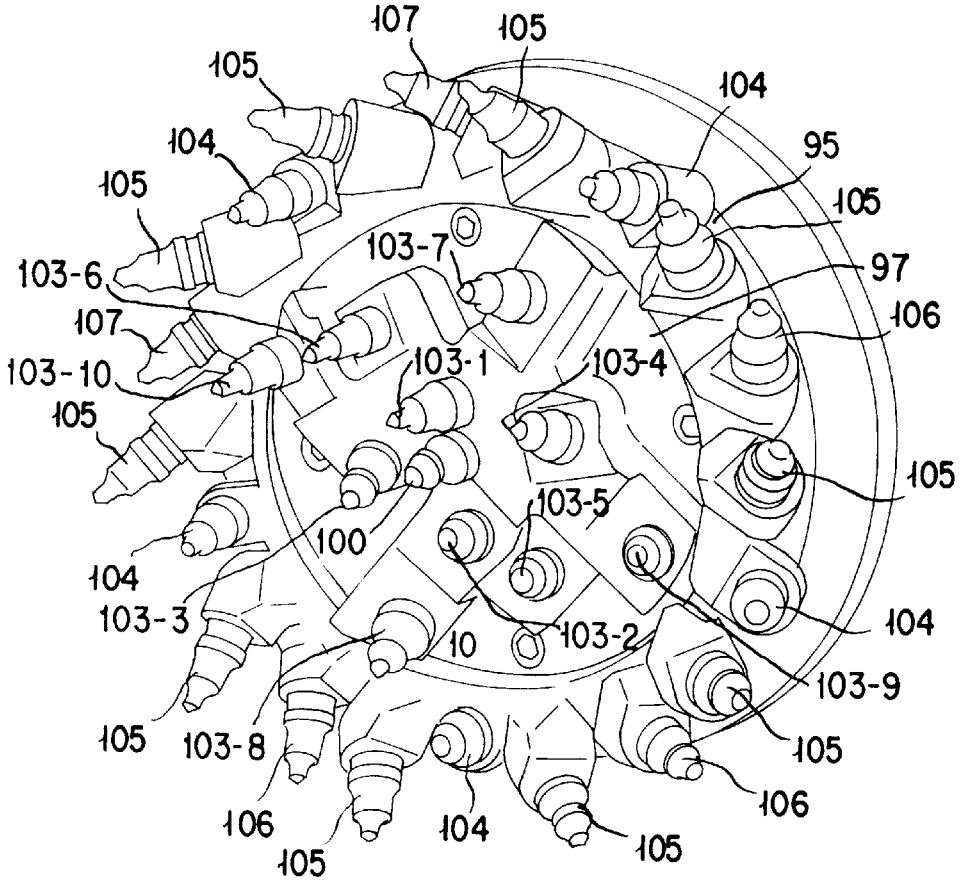
FIG. 11 is a perspective view of the arrangement of the cutting bits.

As shown in FIGS. 10 and 11, a plurality of bit mounting projections 110 are integrally formed to the lower surface of the plate 97. The center side flat surface cutting bits 103 are conical bits each having a mounting shaft fitted and mounted to a vertical hole of the bit mounting projection 110.

The center side flat surface cutting bits 103 are mounted to portions with distances subsequently different from the rotational center of the plate 97 so that the cutting circular tracks of the center side flat surface cutting bits 103 describe concentric circles. Further, two center side flat surface cutting bits 103 describing adjacent concentric circles are positioned on the same line passing the rotational center, and when it is assumed that such two center side flat surface cutting bits 103 constitute one pair, a plurality of pairs are arranged at positions shifted respectively in the rotating direction. Further, bit tip end portions 103*a* of the respective center side flat surface cutting bits 103 are located in the same level in height thereof.

The above structure will be described more in detail hereunder.

For example, the first center side flat surface cutting bit 103-1 positioned most near the rotational center and the next second center side flat surface cutting bit 103-2 are positioned on the same line passing the rotational center, and in the like manner, each pair of the third center side flat surface cutting bit 103-3 and the fourth center side flat surface cutting bit 103-4, the fifth center side flat surface cutting bit 103-5 and the sixth center side flat surface cutting bit 103-6, the seventh center side flat surface cutting bit 103-7 and the eighth center side flat surface cutting bit 103-8, and the ninth center side flat surface cutting bit 103-9 and the tenth center side flat surface cutting bit 103-10 are positioned respectively on a plurality of same lines passing the rotational center.

Furthermore, the adjacent two cutting bit pairs are shifted in phases by substantially 90° in the rotational direction. For example, a pair of first and second center side flat surface cutting bits 103-1 and 103-2 and a pair of third and fourth center side flat surface cutting bits 103-3 and 103-4 are shifted in phases by substantially 90° in the rotational direction.

As mentioned above, since a plurality of center side flat surface cutting bits 103 are arranged in positions different respectively from the rotational center and shifted in the rotational direction from each other, the portions of the road surface near the central portion thereof can be effectively cut.

The plurality of outer peripheral side flat surface cutting bits 104 are mounted with equal intervals in the rotational direction and arranged at portions different from each other from the rotational center so that cutting circular tracks thereof describe concentric circles. These outer peripheral side flat surface cutting bits 104 have bit tip end portions 104*a* arranged in the same level in heights thereof, and the tip end portions 104*a* project slightly downward from the tip end portions 103*a* of the center side flat surface cutting bits 103.

According to the structure mentioned above, when the road surface is deeply cut, portions of the road surface to be cut are cut in a ring-shape by the outer peripheral side flat surface cutting bits 104, and thereafter, the central portion of the ring-shaped cut portion is cut by the center side flat surface cutting bits 103, so that the road surface can be effectively cut.

The plurality of sweep-cutting bits 105 are mounted with equal intervals in the rotational direction so as to be directed obliquely to the front side and outer side in the rotational direction with respect to a perpendicular direction. The sweep-cutting bits 105 have bit tip end portions 105*a* arranged in the same level in heights thereof and at portions with equal distance from the rotational center, the tip end portions 105*a* performing the cutting operation so as to describe one circular track. These bit tip end portions 105*a* of the sweep-cutting bits 105 project slightly downward from the bit tip end portions 104*a* of the outer peripheral side flat surface cutting bits 104.

The plurality of first side surface cutting bits 106 and the plurality of second side surface cutting bits 107 are mounted with spaces from the rotational center, and the plurality of first side surface cutting bits 106 and the plurality of second side surface cutting bits 107 are arranged obliquely to the front side and the outer side in the rotational direction with respect to vertical attitudes thereof.

The plurality of first side surface cutting bits 106 have bit tip end portions 106*a* positioned at portions with the same distance from the rotational center and in the same level in heights thereof. The bit tip end portions 106*a* are positioned upper outer side from the bit tip end portions 103*a* of the center side flat surface cutting bit 103. The plurality of second side surface cutting bits 107 have bit tip end portions 107*a* positioned at portions with the same distance from the rotational center and in the same level in heights thereof. The bit tip end portions 107*a* are positioned upper side of the bit tip end portions 106*a* of the first side surface cutting bits 106.

The bit tip end portion 100*a* of the main cutting bit 100 projects downward over the bit tip end portion 105*a* of the sweep-cutting bit 105.

The sweep-cutting bit 105 and the first and second side surface cutting bits 106 and 107 are constructed by mounting conical bits to bit holders, respectively, and the bit holders are secured to the cylindrical member 95.

According to the structure mentioned above, when the cutting bit mounting member 99 is moved downward, the main cutting bit 100 is first contacted to the road surface, the sweep-cutting bit 105 is then contacted to the road surface, and thereafter, the outer peripheral side flat surface cutting bits 104, the center side flat surface cutting bits 103, the first side surface cutting bits 106 and the second side surface cutting bits 107 are subsequently contacted to the road surface.

The road surface cutting operation by using the embodiment mentioned above will be described hereunder.

The boom 4 and the arm 6 are moved to positions shown in FIG. 1 so that the road surface cutting apparatus A takes its substantially perpendicular attitude, and the rotational member 64 is rotated by the hydraulic motor 50 to thereby rotate and drive the cutting bit mounting member 99.

Figure 12:
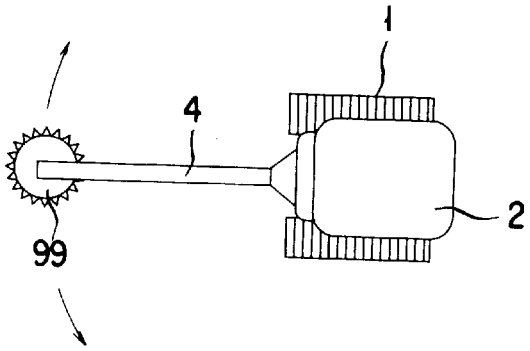
FIG. 12 is a view explaining a sweep-cutting working using the road cutting apparatus.

Under the state mentioned above, the boom 4 is swung downward to move the road surface cutting apparatus. A downward such that the main cutting bit 100 is pressed against the road surface with a light force, and under the state, the road surface is cut in a circular shape. When the main cutting bit 100 has cut the road surface, the sweep-cutting bit 105 is then contacted to the road surface, and under this state, as shown in FIG. 12, the machine body 12 is turned horizontally to swing bilaterally the boom 4 together with the cutting bit mounting member 99, thereby cutting the road surface in a circular shape by the sweep-cutting bit 105.

As mentioned above, only the sweep-cutting bit 105 is pressed against the road surface to effectively cut the road surface thereby in the circular shape while determining the height of the cutting bit mounting member 99 by the main cutting bit 100. Accordingly, an old and irregular road surface can be effectively made flat.

Figure 13E:
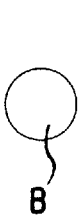
FIG. 13 is a view explaining cutting operation performed to the peripheral road portion of a manhole remaining uncut by using the road cutting apparatus.
Figure 13D:
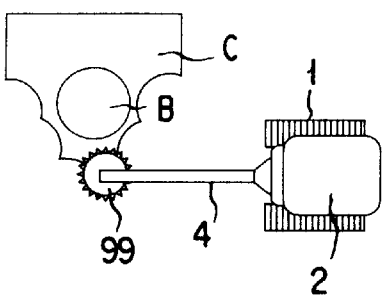
Figure 13C:
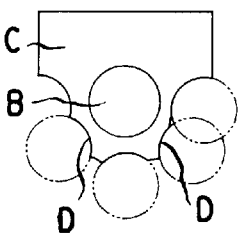
Figure 13B:
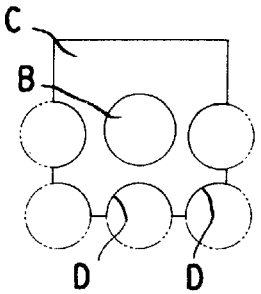
Figure 13A:
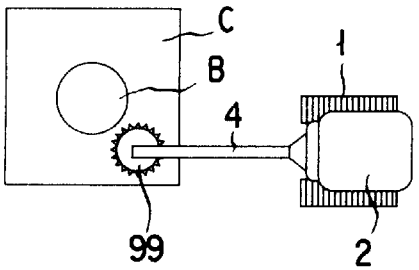

Furthermore, as shown in FIG. 13, for example, when a road surface C in the periphery of a manhole B is cut after the road surface cutting operation of a road cutting machine called as road cutter, as shown in FIG. 13A, the boom 4 is swung downward in a manner mentioned above and the road surface is deeply cut in sequence in shape of circle by the main cutting bit 100, the sweep-cutting bit 105, the outer peripheral side flat surface cutting bits 104, the center side flat surface cutting bits 103 and the first and second side surface cutting bits 106 and 107.

In this cutting operation, since the main cutting bit 100 cuts the road surface in shape of hole, the cutting bit mounting member 99 can be rotated about the main cutting bit 100 without being swung in not only front and rear direction but also bilateral direction, and as a result, the road surface can be effectively deeply cut in the circular shape.

In the next step, as shown in FIGS. 13B and 13C, a plurality of road surface portions are cut in deep circles as mentioned above and portions D remaining between the circles are also cut in the like manner. When the road surface portion near the manhole B is cut, as shown in FIG. 13D, the main cutting bit 100 is pressed against the bottom portion of the circularly cut portion D, and the machine body 2 is turned bilaterally to press the first and second side surface cutting bits 106 and 107 against the upper portion of the vertical surface near the manhole B to cut this portion. At a time when this cutting operation progresses to some extent, the sweep-cutting bit 105 is pressed against the lower portion of the vertical surface to cut this portion.

According to such manner, as shown in FIG. 13E, the road surface around the manhole B, only which remains, is subjected to the cutting operation. Further, it is to be noted that, in a case when a large road cutting machine is used, more than three side surface cutting bits may be mounted with spaces in the vertical direction.

Furthermore, the cutting reaction force at the time of cutting the road surface by using the cutting bits in the manner mentioned above is transmitted to the motor mounting member 20 through the rotational member 64, the shaft 53 and the motor case 51 and then transmitted to the mounting member 20 through the shock-absorber mechanism 31. Consequently, the cutting reaction force is held by the traveling body 1 through the arm 6, the boom 4 and the machine body 2.

In the conventional structure, since no shock-absorber means is provided, when the cutting bits collide with, for example, projections of a road surface and an impact force is thereby caused in the rotating direction, the arm 6 and the boom 4 are swung in the bilateral direction and metal creak noise is generated. According to the present invention, however, since the motor mounting member 30 and the transverse plate member 21 of the mounting member 20 are coupled through the shock-absorber mechanism 31 as mentioned above, the impact force in the rotating direction can be absorbed by the shock-absorber mechanism 31. Accordingly, such metal creak noise is never caused even if the arm 6 and the boom 4 are swung bilaterally.

Furthermore, since the shock-absorber mechanism 31 is composed of a plurality of shock-absorbers 32 provided with shock-absorber bodies 36, which are arranged with spaces along the circular track, the impact force in the rotating direction can be surely absorbed by the plurality of shock-absorber bodies 36.

Still furthermore, since the shock-absorbers 32 are arranged along the circumferential portion of the outer periphery of the hydraulic motor 50 with a space from each other, the distance from the rotational center of the hydraulic motor 50 to each of the shock-absorbers 32 is made long and, for this reason, an impact force acting on one shock-absorber bodies 36 is made small, so that the durability of the shock-absorber bodies 36 can be improved and even a large impact force can be absorbed.

Further, even in a case where the shock-absorber body 36 of the shock-absorber 32 is shared or where the first shock-absorbing member 34 and the second shock-absorbing member 35 are separated from the plate 33 and the mounting member 20 and the motor mounting member 30 are separated from each other, the motor mounting member 30 can be lifted upward by lifting upward the mounting member 20 through the engagement of the bent piece 41*a* with the bent piece 44*a* because the bent piece 41*a* of the other side vertical piece 41 of the first mounting plate 37 and the bent piece 44*a* of the vertical piece 44 of the second mounting plate 38 are opposed to each other in the vertical direction.

Accordingly, as mentioned above, even in the case where the mounting member 20 and the motor mounting member 30 are separated from each other, the boom 4 is swung upward and the road cutting apparatus A can be lifted upward and conveyed, thus being convenient.

Furthermore, the annular mounting surface 60 of the housing 51*a* of the motor case 51 of the hydraulic motor 50 (axial intermediate portion of the hydraulic motor 50) is mounted to the motor mounting member 30 and the end cover 51*b* of the motor case 51 projects between a pair of vertical plates 22 of the mounting member 20 through the hole 63 of the motor mounting member 30, so that the distance from the mounting member 20 to the cutting bit can be made short, and as a result, the entire length of the road cutting apparatus A can be made short and compact.

Still furthermore, the rotational member 64 is supported rotatably at the outer peripheral surface of the housing 51*a* of the motor case 51, a speed reduction gear mechanism 66 is disposed inside the rotational member 64, and, moreover, an upper portion of a cylindrical member 93 is mounted to an attachment flange 65 provided to the axial intermediate portion at the outer peripheral surface of the rotational member 64 in a state that the rotational member 64 projects into the cylindrical member 93, so that the distance between the hydraulic motor 50 and the cutting bit mounting member 99 of the road cutting apparatus A can be made short, and furthermore, the cutting bit mounting member 99 is firmly supported by the housing 51*a* of the motor case 51 of the hydraulic motor 50, so that the cutting bit mounting member 99 is not swung by the cutting resistance at the road cutting time, and hence, the output torque of the hydraulic motor 50 can be surely transmitted to the cutting bit mounting member 99.

In the foregoing description, although the present invention is described about the road cutting, the present invention is applicable to the cutting of side walls of a tunnel or the like by swinging upward the boom 4 and the arm 6 and operating the road cutting apparatus A in substantially horizontal attitude or obliquely vertical attitude.

Still furthermore, according to the present invention, stopper devices 120 are provided for limiting the deformation of the shock-absorbers 32 in the rotating direction at the repeated cutting of the road surface by the cutter bit and also limiting the vertical deformation of the shock-absorbers 32 at the repeated cutting of the vertical surface by the first and second side surface cutting bits 106 and 107.

The stopper device 120 is composed of, as shown in FIGS. 2, 3, 4 and 5, a first member 121 attached to the transverse plate 21 with an angular space of about 90° and a rectangular columnar second member 122 attached to the lower surface of the motor mounting member 30 with an angular space of about 90°. The first member 121 has a lower end portion 121*a* which is bent in hook shape facing the lower surface of the motor mounting member 30 and the second member 122.

Accordingly, the deformation of the shock absorber 32 in the rotating direction can be prevented through the abutting of the lower end portion 121*a* of the first member 121 against the second member 122, and the deformation of the shock-absorber 32 in the vertical direction can also be prevented through the abutting of the lower end portion 121*a* of the first member 121 against the lower surface of the motor mounting member 30.

Although, in the embodiment mentioned above, the present invention was described by way of a preferred example utilizing a power shovel, a road cutter may be constituted by mounting a road cutting apparatus to an arm of a groove cutter, called as a back hoe, which is mounted to a rear body portion of a bulldozer, dozer shovel, wheel loader or the like, or a groove cutter having a body mounted to be swivel to a body of on-road truck.

Further, it is a self-evident matter by those skilled in the art that although the present invention was described with reference to the exemplary embodiments, other various changes, deletions and additions can be made without departing from the subject and scope of the present invention with respect to the described embodiments. Accordingly, it is to be understood that the present invention is not limited to the described embodiments and includes a scope prescribed by the elements recited in the claims and a scope equivalent thereto.

What is claimed is:

1. A road cutting machine comprising a machine body mounted to a travelling body to be swivel, a boom mounted to the machine body to be swingable in a vertical direction, an arm mounted to the boom to be swingable in a vertical direction and a road cutting apparatus mounted to the arm, said road cutting apparatus including a mounting member attached to the arm, a hydraulic motor mounted to the mounting member and a cutting bit mounting member rotated by the hydraulic motor and provided with a plurality of cutting bits, and said cutting bit mounting member being provided with a main cutting bit mounted to a center of rotation, a plurality of flat surface cutting bits attached in a range from the rotation center side to an outer periphery side, a plurality of sweep-cutting bits attached on the outer periphery side and a plurality of side surface cutting bits attached on the outer periphery side, wherein a bit tip end portion of the main cutting bit is positioned in a lowermost position, bit tip end portions of the sweep-cutting bits are positioned above the bit tip end portion of the main cutting bit, bit tip end portions of the flat surface cutting bits are positioned above the tip end portions of the sweep-cutting bits, and bit tip end portions of the side surface cutting bits are positioned in a uppermost portions.

2. A road cutting machine according to claim 1, wherein said flat surface cutting bits are composed of a plurality of flat surface cutting bits arranged on the side of the rotation center and a plurality of flat surface cutting bits arranged on the side of the outer periphery, said flat surface cutting bit on the side of the outer periphery having bit tip end portions positioned slightly below the bit tip end portions of said flat surface cutting bits on the side of the rotation center.

3. A road cutting machine according to claim 2, wherein said flat surface cutting bits on the side of the rotation center are attached at positions different from the rotation center, respectively, and shifted in the rotating direction, respectively, and said flat surface cutting bits on the side of the outer periphery are attached at positions different from the rotation center with substantially equally separated relation to each other in the rotating direction.

4. A road cutting machine according to claim 1, wherein said sweep-cutting bits and said side surface cutting bits are arranged so as to be obliquely disposed forward and outward in the rotating direction with respect to a perpendicular direction.

5. A road cutting machine according to claim 1, wherein said side surface cutting bits are composed of a first group of side surface cutting bits and a second group of side surface cutting bits, said second group of side surface cutting bits having bit tip end portions positioned above bit tip end portions of said first group of side surface cutting bits.

* * * * *